US010299527B2

(12) United States Patent
Cho

(10) Patent No.: US 10,299,527 B2
(45) Date of Patent: May 28, 2019

(54) HEADWEAR HAVING SIZE ADJUSTMENT DEVICE

(71) Applicant: YUPOONG, INC., Seoul (KR)

(72) Inventor: Byoung-Woo Cho, Seoul (KR)

(73) Assignee: YUPOONG, INC., Seoul (KR)

( * ) Notice: Subject to any disclaimer, the term of this patent is extended or adjusted under 35 U.S.C. 154(b) by 0 days.

(21) Appl. No.: 15/213,988

(22) Filed: Jul. 19, 2016

(65) Prior Publication Data

US 2016/0345649 A1 Dec. 1, 2016

Related U.S. Application Data

(62) Division of application No. 14/046,490, filed on Oct. 4, 2013, now Pat. No. 9,655,397.

(51) Int. Cl.
*A42B 1/22* (2006.01)

(52) U.S. Cl.
CPC ..... *A42B 1/22* (2013.01)

(58) Field of Classification Search
CPC ..... A63B 71/10; A42B 1/062
See application file for complete search history.

(56) References Cited

U.S. PATENT DOCUMENTS 4,888,831 A * 12/1989 Oleson ..... A42B 3/145 2/420
5,608,917 A * 3/1997 Landis ..... A42B 3/14 2/11
5,704,072 A * 1/1998 Garneau ..... A42B 3/085 2/421
6,094,749 A * 8/2000 Proctor ..... A42B 1/004 2/171.1
6,973,677 B2 * 12/2005 Diaz ..... A41D 13/11 128/201.19
7,752,682 B2 * 7/2010 VanDerWoude ... A41D 13/0025 2/171.3
9,161,584 B1 * 10/2015 Garrett, Jr. ..... A42B 1/004
9,655,397 B2 * 5/2017 Cho ..... A42B 1/22
2002/0069452 A1 * 6/2002 Knappl ..... A42B 3/00 2/411
2006/0156448 A1 * 7/2006 Garneau ..... A42B 3/085 2/10
2009/0229041 A1 * 9/2009 Tufenkjian ..... A42B 1/24 2/414
2014/0101820 A1 * 4/2014 Cho ..... A42B 1/22 2/171

FOREIGN PATENT DOCUMENTS

DE 102006058782 * 6/2008
FR 2690053 * 10/1993

* cited by examiner

*Primary Examiner* — Khaled Annis
*Assistant Examiner* — Brieanna Szafran
(74) *Attorney, Agent, or Firm* — Lex IP Meister, PLLC

(57) ABSTRACT

Headwear having an opening and a size adjustment device that are formed in a head receiving portion is provided, wherein the size adjustment device includes a first size adjustment unit that is disposed at a lower part of the opening and that can adjust a minute size, and a second size adjustment unit that is connected to the first size adjustment unit to adjust a size to a constant gap. Thereby, headwear that can adjust a minute size and that can satisfy various head sizes without an oppressive feeling can be provided.

10 Claims, 12 Drawing Sheets

HEADWEAR HAVING SIZE ADJUSTMENT DEVICE

CROSS REFERENCE TO RELATED APPLICATIONS

This application is a Divisional of U.S. patent application Ser. No. 14/046,490, filed Oct. 4, 2013, titled "HEADWEAR HAVING SIZE ADJUSTMENT DEVICE", which claims priority to and the benefit of Korean Patent Application No. 10-2012-0115070 filed in the Korean Intellectual Property Office on Oct. 16, 2012, the entire contents of both of which are incorporated herein by reference.

FIELD OF THE INVENTION

The present invention relates to headwear having a size adjustment device. More particularly, the present invention relates to headwear having a size adjustment device that can adjust a minute size using shape deformation of at least one hole of a first size adjustment unit that is provided at the edge of a lower part of a head receiving portion of the headwear.

BACKGROUND OF THE INVENTION

In general, in size adjustment of headwear that can be widely used regardless of a head size, a dome-shaped opening la is formed at a rear surface of headwear 1, and in order to adjust a head circumferential direction length of the headwear 1, size adjustment headwear in which a size adjustment device 100 is installed between both sides of a lower part of the opening 1*a* is widely used.

When the size adjustment device 100 is formed with, particularly, a male size adjustment member 111 in which a plurality of fastening protrusions 111*a* are formed at a predetermined gap and a female size adjustment member 113 in which a plurality of fastening holes 113*a* corresponding to the plurality of fastening protrusions 111*a* are formed, the size adjustment device 100 has an uncomplicated structure, can be easily produced, and a size thereof can be easily adjusted, and after the size adjustment device 100 is adjusted to correspond to a head size, the size adjustment device 100 is not easily unfastened, and the size adjustment device 100 has a merit that a person having long hair can bind back their hair and extract the hair to the outside through the opening 1*a*, the size adjustment device 100 is widely used.

However, as shown in FIG. 1, in such type of size adjustment device 100, because the fastening protrusion 111*a* and the fastening hole 113*a* are disposed at, for example, a gap of 1 cm, after two fastening protrusions 111*a* and fastening holes 113*a* are fastened, when one fastening protrusion 111*a* and fastening hole 113*a* are fastened, a size can be adjusted by only 1 cm, which is a fixed size and thus wearers having various head sizes cannot be satisfied.

That is, when a person having a head circumference of 58.5 cm wears the headwear 1 having such type of size adjustment device 100, if a size of the headwear 1 is adjusted to 58 cm, the person may feel that the headwear 1 is small, and when the person unfastens the size adjustment device 100, moves the fastening hole 113*a* backward by one size, adjusts to a size of 59 cm, and couples the fastening hole 113*a* and the fastening protrusion 111*a*, the person may feel that the headwear 1 is large.

Therefore, persons who highly consider wearing comfort of headwear that is well fitted to persons' heads may dislike the headwear having the size adjustment device 100.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a headwear having a size adjustment device having advantages of satisfying various head sizes without an oppressive feeling and providing various designs together with a merit of a size adjustment device using a conventional female and male size adjustment member.

An exemplary embodiment of the present invention provides a headwear having an opening and a size adjustment device that are formed in a head receiving portion, wherein the size adjustment device includes a first size adjustment unit that is disposed at a lower part of the opening and that can adjust a minute size, and a second size adjustment unit that is connected to the first size adjustment unit to adjust a size at a constant gap.

According to an exemplary embodiment of the present invention, a size adjustment device has an uncomplicated structure, can be easily produced, and can adjust a minute size, and after the size adjustment device is adjusted to correspond to a head size, the size adjustment device is not easily unfastened, so a person having long hair can bind back their hair and extract the hair to the outside through an opening, and headwear having a size adjustment device that can satisfy various head sizes without an oppressive feeling and that provides various designs can be provided.

DETAILED DESCRIPTION OF THE PREFERRED EMBODIMENTS

Figure 1:
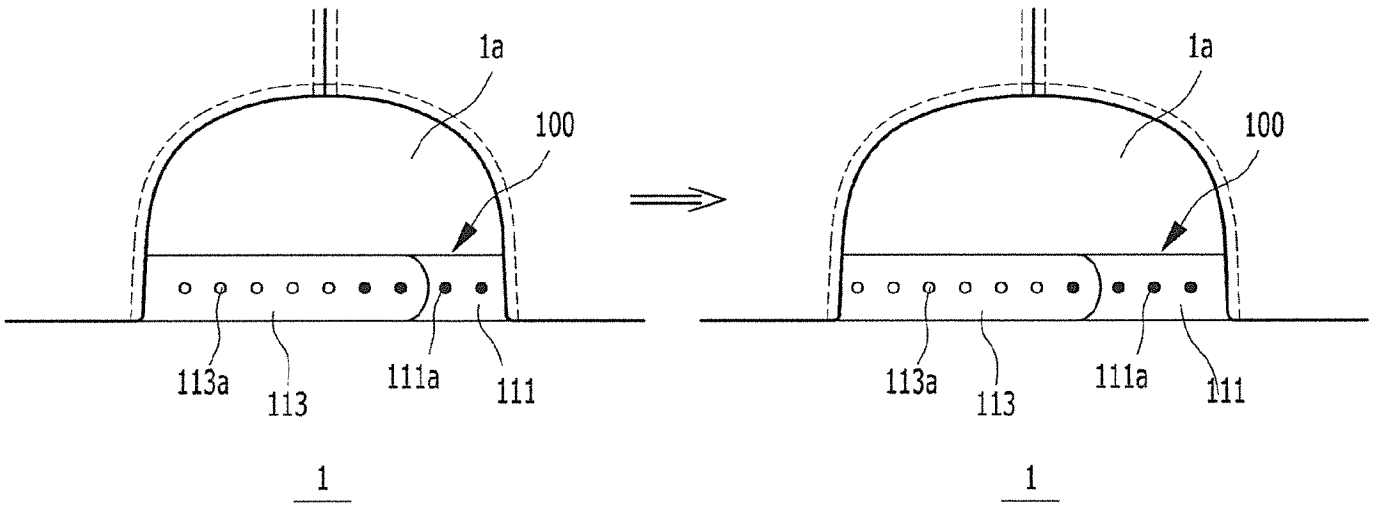
FIG. 1 is a schematic diagram for describing a problem of headwear having a conventional size adjustment device.

Hereinafter, exemplary embodiments of the present invention will be described in detail with reference to the attached drawings.

Like reference numerals designate like elements throughout the specification.

Further, detailed descriptions of well-known functions and structures incorporated herein may be omitted to avoid obscuring the subject matter of the present invention.

In this specification, headwear includes various headwear forms such as a hat and a visor as well as baseball headwear, and a second size adjustment unit may use various materials such as conventional plastic, cloth, and leather and various size adjustment members such as a female and male coupling type, a string, a buckle, and a band form.

First, a headwear having a size adjustment device according to an exemplary embodiment of the present invention will be described with reference to FIG. 2.

Figure 2:
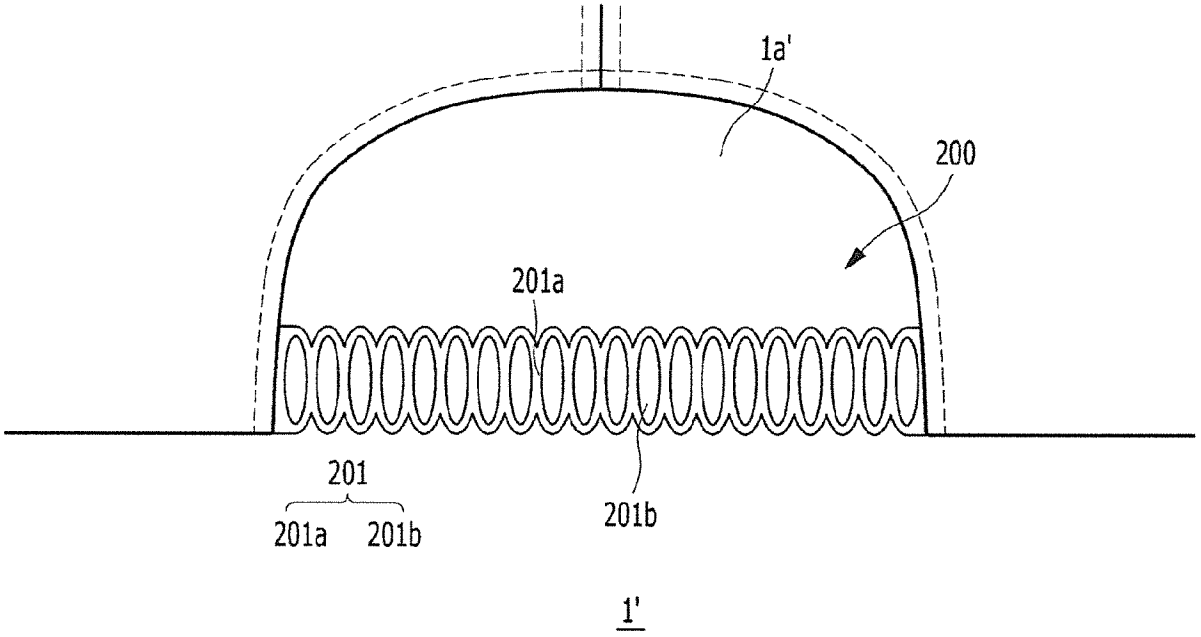
FIG. 2 is a partial rear view illustrating headwear having a size adjustment device according to an exemplary embodiment of the present invention.

FIG. 2 is a partial rear view illustrating headwear having a size adjustment device according to an exemplary embodiment of the present invention.

Referring to FIG. 2, according to an exemplary embodiment of the present invention, a dome-shaped opening 1*a* is formed at a rear surface of headwear 1', and in order to adjust a head circumference direction length of the headwear 1', a size adjustment device 200 is installed between both sides of a lower part of the opening 1*a'*.

The size adjustment device 200 according to an exemplary embodiment of the present invention includes a size adjustment member 201 that is provided between both sides of a lower part of the opening 1*a'* in a head circumference direction of the headwear 1' and that can adjust a minute length.

The size adjustment member 201 includes a body 201*a* that is made of a flexible material and that is formed long in a head circumferential direction, and at least one of shape change holes 201*b* disposed at a predetermined gap in the body 201*a*.

The body 201*a* is made of a plate-shaped material having predetermined flexibility and may be stretchable as much as a predetermined length, and even when the body 201*a* does not have predetermined flexibility, the shape change hole 201*b* may provide predetermined elasticity by being formed at a predetermined gap along the long side of a length direction of the body 201*a*.

In order to easily adjust a size by a shape change, the shape change hole 201*b* may be formed in various shapes such as a wrinkle shape, a spring shape, or a wave shape.

When a force is applied to the body 201*a* in a head circumferential direction, the size adjustment member 201 is formed to adjust a minute size while deforming a shape of the shape change hole 201*b*.

This will be described in detail in a description of a size adjustment device and headwear using the same according to another exemplary embodiment of the present invention with reference to FIGS. 3 to 5.

Figure 3:
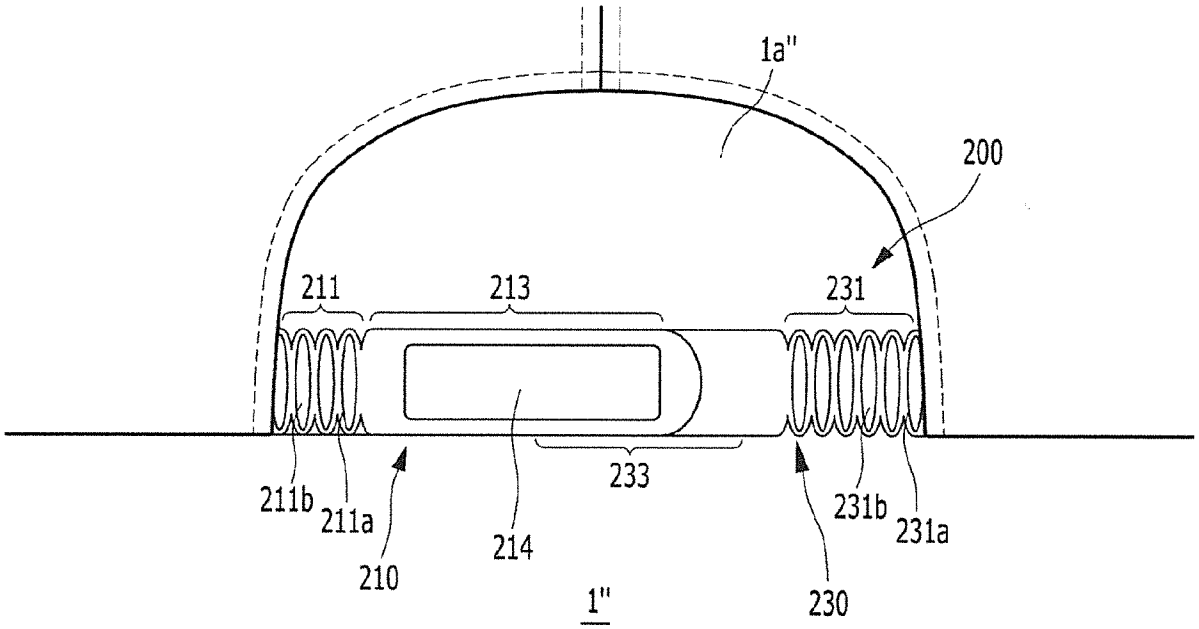
FIG. 3 is a partial rear view illustrating headwear having a size adjustment device according to another exemplary embodiment of the present invention.
Figure 4:
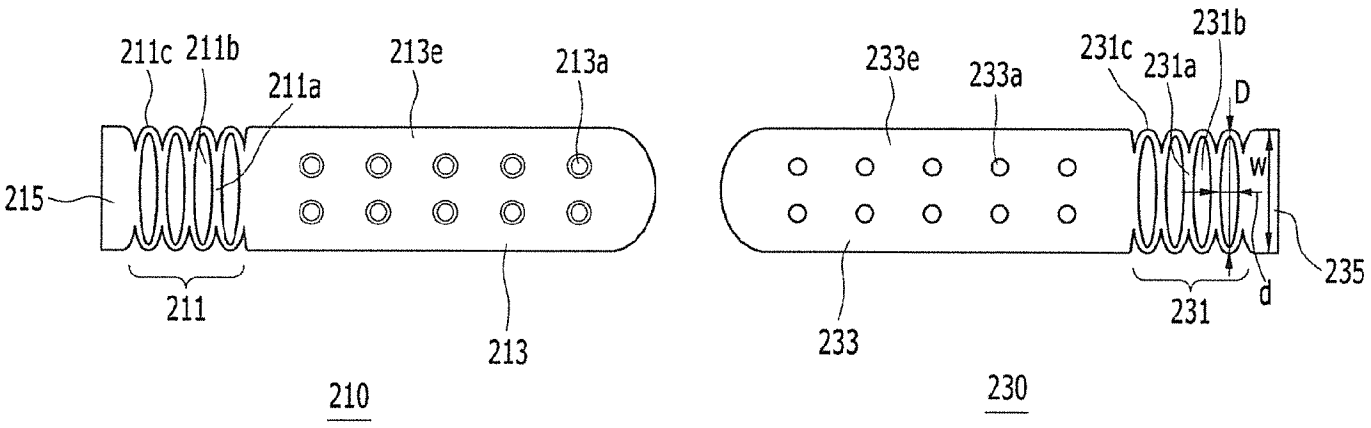
FIG. 4 is a schematic diagram illustrating a configuration of a size adjustment device according to another exemplary embodiment of the present invention.
Figure 5:
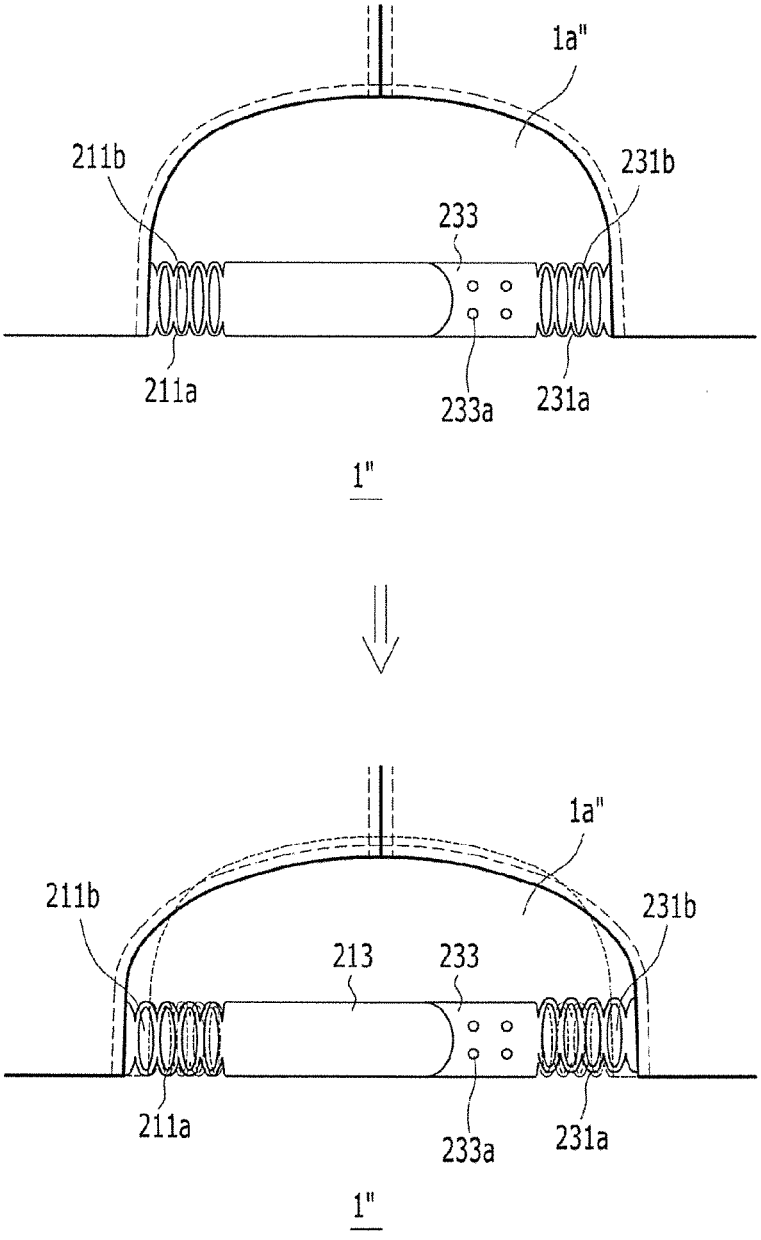
FIG. 5 is a schematic view illustrating a method of driving a size adjustment device according to another exemplary embodiment of the present invention.

FIG. 3 is a partial rear view illustrating headwear having a size adjustment device according to another exemplary embodiment of the present invention, FIG. 4 is a schematic diagram illustrating a configuration of a size adjustment device according to another exemplary embodiment of the present invention, and FIG. 5 is a schematic view illustrating a method of driving a size adjustment device according to another exemplary embodiment of the present invention.

Referring to FIGS. 3 to 5, a size adjustment device 200 according to another exemplary embodiment of the present invention may include a pair of size adjustment members 210 and 230.

The pair of size adjustment members 210 and 230 may respectively include first size adjustment units 211 and 231 and second size adjustment units 213 and 233. One end of each of the first size adjustment units 211 and 231 is coupled to both sides of a lower part of an opening 1*a*" that is partially formed in a head receiving portion of the head wearer 1", and each of the second size adjustment units 213 and 233 is provided with at least one of female or male fastening portions 213*a* and 233*a* integrally formed in the other side of each of the first size adjustment units 211 and 231 and arranged with a constant gap.

The first size adjustment units 211 and 231 include bodies 211*a* and 231*a* that are formed long in a head circumferential direction and at least one of shape change holes 211*b* and 231*b* that are disposed at a predetermined gap in the bodies 211*a* and 231*a*.

The shape change holes 211*b* and 231*b* are disposed at a predetermined gap in a length direction along an inner center line of the bodies 211*a* and 231*a* of the first size adjustment units 211 and 231, a longitudinal diameter D of each of the shape change holes 211*b* and 231*b* almost corresponds to a width W of each of the bodies 211*a* and 231*a*, and a gap between the respective shape change holes 211*b* and 231*b* may be smaller than a transverse diameter d of each of the shape change holes 211*b* and 231*b*.

In this way, the longitudinal diameter D of each of the shape change holes 211*b* and 231*b* almost corresponds to the width W of each of the bodies 211*a* and 231*a* of the first size adjustment units 211 and 231, and, it is preferable that a size can be most variously adjusted when a gap between the shape change holes 211*b* and 231*b* is formed to be smaller than the transverse diameter d of each of the shape change holes 211*b* and 231*b*, but the shape change holes 211*b* and 231*b* may have various shapes.

For example, the shape change holes 211*b* and 231*b* may be formed in the shape of an oval having the long side in a longitudinal direction, but the shape of the shape change holes 211*b* and 231*b* is not limited thereto and may be formed in various shapes such as a rectangle shape long in a longitudinal direction, a rhombus shape, and a diamond shape in order to easily adjust a size, and may be replaced in various shapes such as a wrinkle shape, a spring shape, and a wave shape if the bodies 211*a* and 231*a* are formed in vertical symmetry to receive uniform tension.

In this way, because the first size adjustment units 211 and 231 have the at least one of shape change holes 211*b* and 231*b*, as shown in FIG. 5, for example, for a wearer having a head circumference size of 58.3 cm, a head circumference size is set to 58 cm by overlapping the second size adjustment units 213 and 233 and by coupling the female or male fastening portions 213*a* and 233*a* that are formed at a gap of 1 cm in the second size adjustment units 213 and 233, and the head circumference size can be minutely adjusted to 58.3 cm by shape deformation of the at least one of shape change holes 211*b* and 231*b* of the first size adjustment units 211 and 231, and thus the wearer can feel wearing comfort when the headgear is well fitted.

That is, in the size adjustment device 200 according to an exemplary embodiment of the present invention, wearers having various head sizes can experience wearing comfort.

For this purpose, the bodies 211*a* and 231*a* of the first size adjustment units 211 and 231 are made of a synthetic resin such as polyurethane, a phenol resin, a melamine resin, an epoxy resin, silicon, polyethylene, polypropylene, polyvinyl chloride, an ABS resin, polyethylene terephthalate, polyamide, polycarbonate, an acryl resin, EVA, and polystyrene.

In this way, as the bodies 211*a* and 231*a* of the first size adjustment units 211 and 231 are made of a synthetic resin, various sizes can be provided by deformation of the at least one of shape change holes 211*b* and 231*b* while providing predetermined durability, and even if the bodies 211*a* and 231*a* are used for a long period, the bodies 211*a* and 231*a* can be prevented from being deformed, and even when the at least one of shape change holes 211*b* and 231*b* are formed by punching, a separate finish process may not be added and thus product stability can be provided and a production process can be simplified.

Further, because the first size adjustment units 211 and 231 may be formed in a smaller thickness than the second size adjustment units 213 and 233 or use a ductile member, at both sides of the opening 1*a*" of the headwear 1, the first size adjustment units 211 and 231 are easily sewed without a protrusion using coupling portions 215 and 235 that are protruded from one end of the pair of size adjustment members 210 and 230.

In the present exemplary embodiment, one of the female or male fastening portions 213*a* and 233*a* that are protruded from the second size adjustment units 213 and 233 may be a female fastening portion 213*a* and the other one thereof may be a male fastening portion 233*a*, or vice versa.

The female or male fastening portions 213*a* and 233*a* may be provided in a snap fastener form having a female button 213*a* at one surface of the second size adjustment units 213 and 233, preferably at one second size adjustment unit 213 that is disposed at a lower part among the second size adjustment units 213 and 233 and having a male button 233*a* at another second size adjustment unit 233 that is disposed at an upper part to correspond thereto, or vice versa.

However, when the second size adjustment units 213 and 233 are disposed at an upper part, in order to prevent the female or male fastening portions 213*a* and 233*a* from being exposed to the outside, the female or male fastening portions 213*a* and 233*a* may be formed in a lower portion of the second size adjustment units 213 and 233, and a decorative portion 214 may be provided in an upper part of the second size adjustment units 213 and 233.

The decorative portion 214 provides various textures, patterns, and designs that cannot be provided by a synthetic resin through print, ultrasonic welding, heat stamp, and sublimation transfer method.

Hereinafter, an exemplary variation of the size adjustment device 200 according to an exemplary embodiment of the present invention will be described with reference to FIGS. 6A to 6E.

In the exemplary variation of the size adjustment device 200 according to an exemplary embodiment of the present invention, a configuration of first size adjustment units 211 and 231 is the same as that of the size adjustment device 200 according to the exemplary embodiment of the present invention, but female or male fastening portions 213*a* and 233*a* that are formed in the second size adjustment units 213 and 233, the number of the first size adjustment units 211 and 231 and the second size adjustment units 213 and 233, or a coupling position thereof is different from that of the size adjustment device 200 according to the exemplary embodiment of the present invention.

Figure 6A:
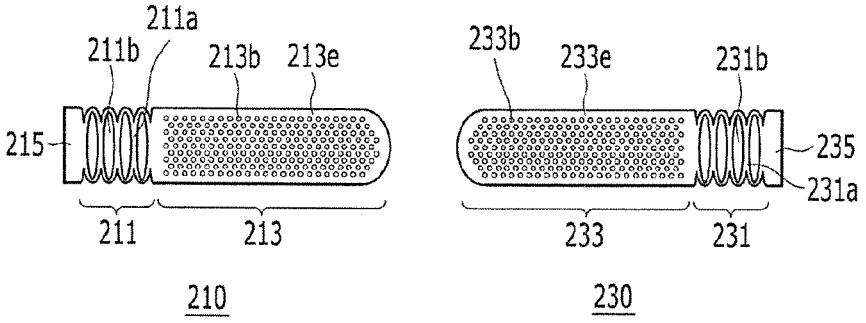
FIGS. 6A to 6E are schematic diagrams illustrating first, second, third, fourth, and fifth exemplary variations, respectively, of a size adjustment device according to another exemplary embodiment of the present invention.

As shown in FIG. 6A, a size adjustment device 200 according to a first exemplary variation of the above-stated exemplary embodiment of the present invention includes a pair of female or male second size adjustment units 213 and 233 that are integrally formed with respect to the pair of first size adjustment units 211 and 231.

In one of the second size adjustment units 213 and 233, female fastening portions, i.e., hooks 213*b*, are formed by engraving in a female body 213*e* that is formed in a plate shape with a synthetic resin, and in the other one of the second size adjustment units 213 and 233, hooks, which are male fastening portions 233*b*, are formed by embossing in a male body 233*e* that is formed in a plate shape with a synthetic resin.

In the size adjustment device 200 according to the first exemplary variation of the above-stated exemplary embodiment of the present invention, female and male bodies 213*e* and 233*e* and female or male fastening portions 213*b* and 233*b* are integrally formed by molding of a synthetic resin in the second size adjustment units 213 and 233.

Figure 6B:
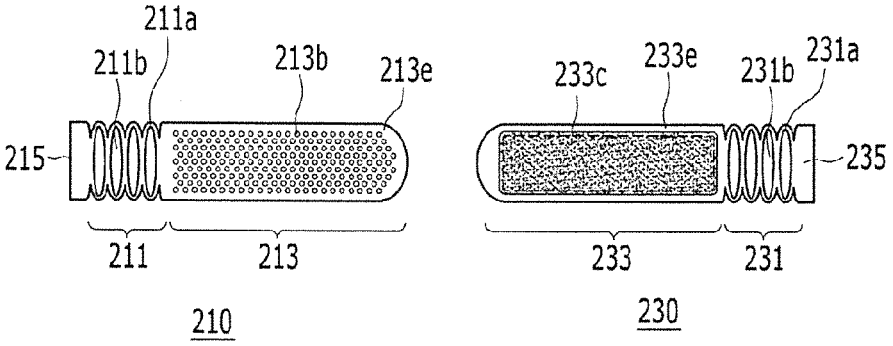

Further, as shown in FIG. 6B, in a size adjustment device 200 according to a second exemplary variation of the above-stated exemplary embodiment of the present invention, in one of the second size adjustment units 213 and 233, a female fastening portions, i.e., hooks 213*b*, are formed by engraving in a female body 213*e* that is formed in a plate shape with a synthetic resin, and in the other one of the second size adjustment units 213 and 233, a plurality of loops 233*c*, which form male fastening portions, are sew-coupled in a fabric cloth form to a male body 233*e* that is formed in a plate shape with a synthetic resin.

In the second exemplary variation of the size adjustment device 200 according to the above-stated exemplary embodiment of the present invention, the female and male bodies 213*e* and 233*e* and the female or male fastening portions 213*b* and 233*c* are integrally formed by molding a synthetic resin in one of the second size adjustment units 213 and 233, and the separated female or male fastening portions 213*c* and 233*c* are sew-coupled to the female and male bodies 213*e* and 233*e* in a fabric cloth form in the other one of the second size adjustment units 213 and 233.

Figure 6C:
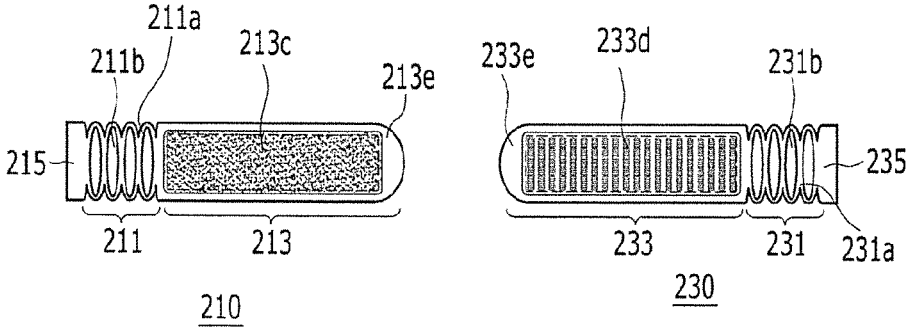

As shown in FIG. 6C, in a third exemplary variation of a size adjustment device 200 according to the above-stated exemplary embodiment of the present invention, in one of the second size adjustment units 213 and 233, loops 213*c*, which form a female fastening portions, are sew-coupled in a fabric cloth form to a female body 213*e* that is formed in a plate shape with a synthetic resin, and in the other one of the second size adjustment units 213 and 233, a plurality of loops 233*d*, which form male fastening portions that are different shape from the loops 213*c* , which form the female fastening portions, are sew-coupled in a fabric cloth form to a male body 233*e* that is formed in a plate shape with a synthetic resin.

In the third exemplary variation of the size adjustment device 200 according to the above-stated exemplary embodiment of the present invention, as separated female or male fastening portions, the loops 213*c* and 233*d* respectively having different shapes are sew-coupled in a fabric cloth form to the female and male bodies 213*e* and 233*e* of the second size adjustment units 213 and 233.

Figure 6D:
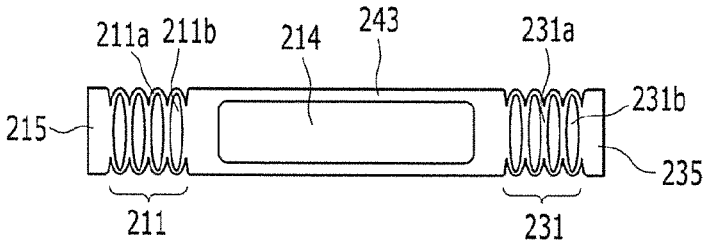

As shown in FIG. 6D, in order to provide a predetermined size, in a size adjustment device 200 according to a fourth exemplary variation of the above-stated exemplary embodiment of the present invention, one of second size adjustment units 243, formed in the shape of a plate having a predetermined length is provided at an intermediate location, and two of first size adjustment units 211 and 231 that can adjust a minute size are provided at respective ends of the second size adjustment unit 243.

Figure 6E:
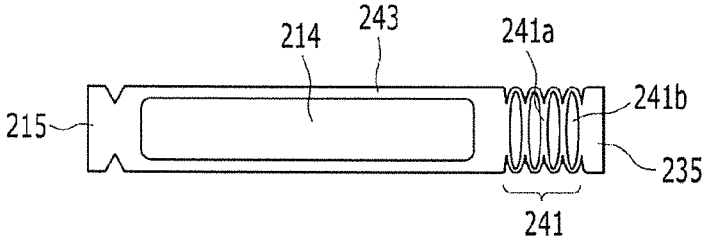

Further, as shown in FIG. 6E, in order to provide a predetermined size, in a size adjustment device 200 according to a fifth exemplary variation of the above-stated exemplary embodiment of the present invention, a single second size adjustment unit 243, formed in the shape of a plate having a predetermined length is provided, and a single first size adjustment unit 241, having a plurality of shape change holes 241*b* in one of lateral ends of the second size adjustment unit 243 and that can adjust a minute size is provided.

In this way, in an exemplary variation of the size adjustment device 200 according to the above-stated exemplary embodiment of the present invention, after a size is first adjusted by the second size adjustment units 213 and 233, even if an effort for adjusting a minute size several times is not performed, wearing comfort of an appropriate size can be provided without an oppressive feeling by shape deformation of at least one shape change holes 211*b*, 231*b*, and 241*b* of the first size adjustment units 211 and 231, and bodies 211*a*, 231*a*, and 241*a* of the first size adjustment units 211, 231, and 241 may be integrally formed at one time with the same synthetic resin as that of the second size adjustment units 213 and 233.

Further, in a size adjustment device 300 according to another exemplary embodiment of the present invention, shape deformation of headwear 1''' that may occur when using an elastic member, for example, an elastic band that is stretchable in a head circumferential direction as a size adjustment device, can be prevented.

Hereinafter, the size adjustment device 300 according to another exemplary embodiment of the present invention will be described with reference to FIGS. 7 to FIG. 9E.

Figure 7:
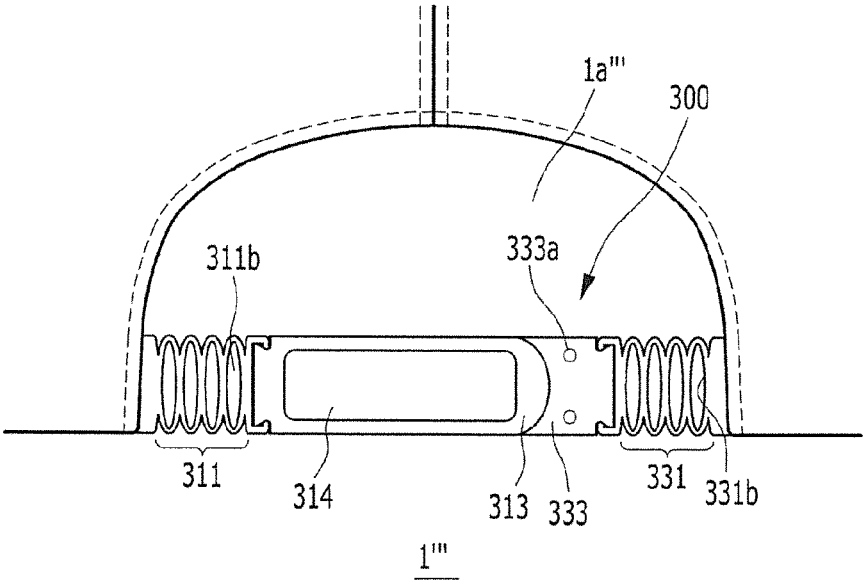
FIG. 7 is a partial rear view illustrating headwear having a size adjustment device according to another exemplary embodiment of the present invention.
Figure 8:
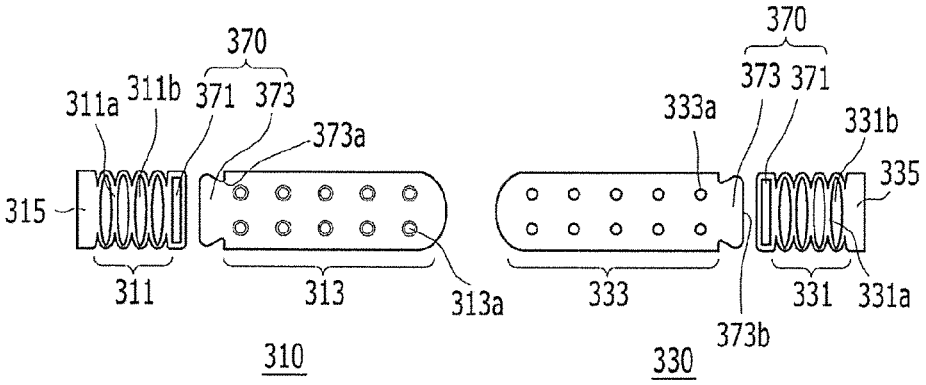
FIG. 8 is a schematic diagram illustrating a configuration of a size adjustment device according to another exemplary embodiment of the present invention.

FIG. 7 is a partial rear view illustrating headwear having a size adjustment device according to another exemplary embodiment of the present invention, FIG. 8 is a schematic diagram illustrating a configuration of a size adjustment device according to the above-stated exemplary embodiment of the present invention, and FIGS. 9A to 9E are schematic diagrams illustrating first, second, third, fourth, and fifth exemplary variations, respectively, of a size adjustment device according to the above-stated exemplary embodiment of the present invention.

As shown in FIGS. 7 and 8, a pair of size adjustment members 310 and 330 of the size adjustment device 300 according to the above-stated exemplary embodiment of the present invention each include first size adjustment units 311 and 331 having one end that is coupled to both sides of a lower part of an opening 1*a'''* that is partially formed in a head receiving portion of the headwear 1''', and second size adjustment units 313 and 333 that are detachably formed in the other end of the first size adjustment units 311 and 331 and that have at least one of female or male fastening portions 313*a* and 333*a* that are disposed at a constant gap in a head circumferential direction for female and male fastening at a predetermined gap.

Further, the first size adjustment units 311 and 331 and the second size adjustment units 313 and 333 may be made of two different kinds of plastic materials, bodies 311*a* and 331*a* of the first size adjustment units 311 and 331 may be made of soft plastic, and the second size adjustment units 313 and 333 may be made of hard plastic. As the bodies 311*a* and 331*a* of the first size adjustment units 311 and 331 are made of soft plastic, the bodies 311*a* and 331*a* have enhanced flexibility and can thus more effectively adjust a minute size.

In a size adjustment device 300 according to the above-stated exemplary embodiment of the present invention, constituent elements identical to or corresponding to those of the foregoing exemplary embodiment will be omitted.

In the size adjustment device 300 according to the current exemplary embodiment of the present invention, in order to detachably couple the other end of the second size adjustment units 313 and 333 to the other end of the first size adjustment units 311 and 331, the pair of size adjustment members 310 and 330 may further include a connection member 370.

The connection member 370 includes a recess 371 that is formed in the other end of the first size adjustment units 311 and 331 and a protrusion 373 that is formed in the other end of the second size adjustment units 313 and 333, and the protrusion 373 may be coupled by fastening to the recess 371, and the recess 371 and protrusion 373 may be disposed vice versa.

The protrusion 373 has a narrow neck 373*a* and a wide head 373*b*, and by bending the head 373*b*, the neck 373*a* is fastened to the recess 371, and thereafter, the head 373*b* is extended to be latched by the recess 371 and is prevented from separating from the recess 371.

The connection member 370 provides various means that connect the other end of the second size adjustment units 313 and 333 to the other end of the first size adjustment units 311 and 331.

Hereinafter, exemplary variations of a size adjustment device 300 according to the above-stated exemplary embodiment of the present invention will be described with reference to FIGS. 9A to 9E.

In an exemplary variation of the size adjustment device 300 according to the above-stated exemplary embodiment of the present invention, a configuration of first size adjustment units 311 and 331 is the same as a configuration of the size adjustment device 300 according to the previous exemplary embodiment of the present invention, and a configuration of second size adjustment units 313 and 333 is the same as a configuration of an exemplary variation according to the previous exemplary embodiment of the present invention, and therefore a detailed description thereof will be described briefly, and only dissimilar constituent elements will be described here in detail.

Figure 9A:
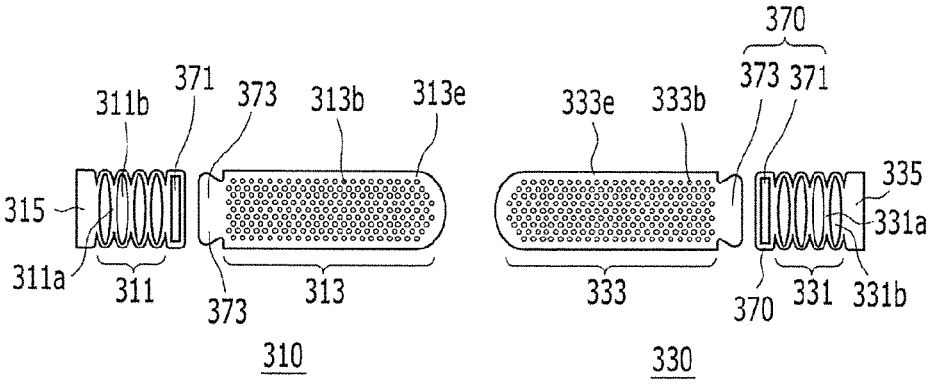
FIGS. 9A to 9E are schematic diagrams illustrating first, second, third, fourth, and fifth exemplary variations, respectively, of a size adjustment device according to another exemplary embodiment of the present invention.

As shown in FIG. 9A, a size adjustment device 300 according to a first exemplary variation of the above-stated exemplary embodiment of the present invention is formed with a pair of size adjustment members 310 and 330, and the pair of size adjustment members 310 and 330 are formed with first size adjustment units 311 and 331 that can adjust a minute size and second size adjustment units 313 and 333 that are detachably coupled thereto using a connection member 370 as an intermediary.

The connection member 370 includes a recess 371 that is formed in the other end of the first size adjustment units 311 and 331 and a protrusion 373 that is formed in the other end of the second size adjustment units 313 and 333, as in the previous exemplary embodiment of the present invention.

Further, in the second size adjustment units 313 and 333, female and male bodies 313*e* and 333*e* and female or male fastening portions 313*b* and 333*b* are integrally formed by shaping a synthetic resin, as in the first exemplary variation of the above-stated exemplary embodiment of the present invention.

Figure 9B:
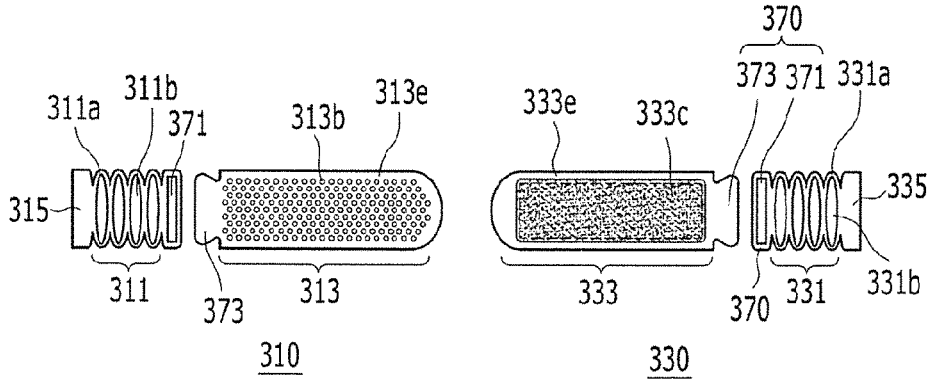

Further, as shown in FIG. 9B, a size adjustment device 300 according to a second exemplary variation of the above-stated exemplary embodiment of the present invention is formed with a pair of size adjustment members 310 and 330, and the pair of size adjustment members 310 and 330 are formed with first size adjustment units 311 and 331 that can adjust a minute size and second size adjustment units 313 and 333 that are detachably coupled thereto using a connection member 370 as an intermediary.

In a second exemplary variation of the size adjustment device 300 according to the above-stated exemplary embodiment of the present invention, one of the second size adjustment units 313 and 333 is integrally formed with female and male bodies 313*e* and 333*e* and female or male fastening portions 313*b* and 333*c* by shaping a synthetic resin, and the other one of the second size adjustment units 313 and 333 is formed by sew-coupling in a fabric cloth form the separated female or male fastening portion 313*b* and 333*c* to the female and male bodies 313*e* and 333*e*.

Figure 9C:
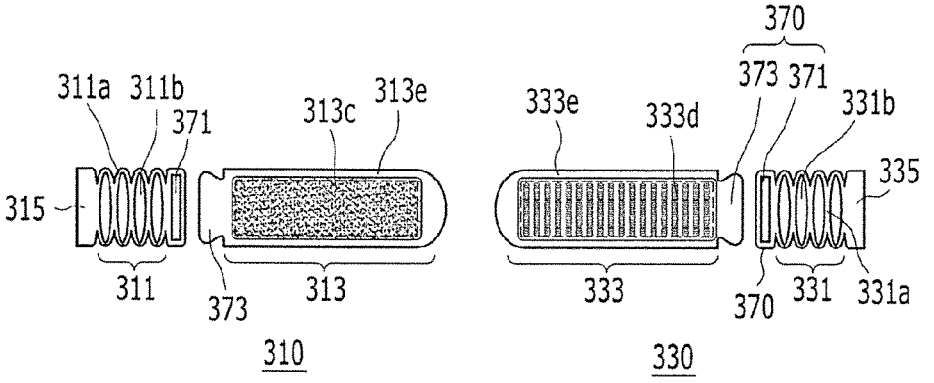

As shown in FIG. 9C, a size adjustment device 300 according to a third exemplary variation of the above-stated exemplary embodiment of the present invention is formed with a pair of size adjustment members 310 and 330, and the pair of size adjustment members 310 and 330 are formed with first size adjustment units 311 and 331 that can adjust a minute size and second size adjustment units 313 and 333 that are detachably coupled thereto using a connection member 370 as an intermediary.

A third exemplary variation of a size adjustment device 300 according to the above-stated exemplary embodiment of the present invention is formed by sew-coupling in a fabric cloth form loops 313*c* and 333*d* having different shapes as separated female or male fastening portions to female and male bodies 313*e* and 333*e* of the second size adjustment units 313 and 333.

Figure 9D:
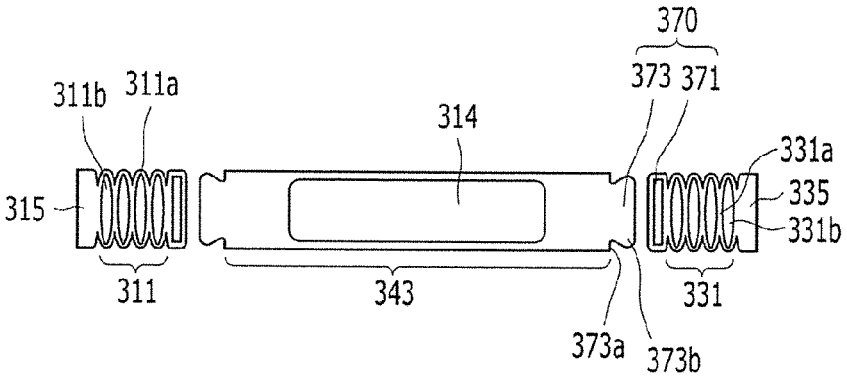

As shown in FIG. 9D, in a size adjustment device 300 according to a fourth exemplary variation of the above-stated exemplary embodiment of the present invention, in order to provide a predetermined size, one second size adjustment unit 343 of a plate shape having a predetermined length is provided at the intermediate, and two first size adjustment units 311 and 331 that can adjust a minute size are provided to both ends of the second size adjustment unit 343.

Figure 9E:
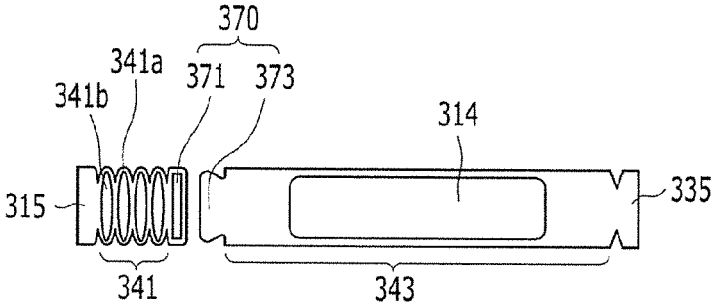

Further, as shown in FIG. 9E, a size adjustment device 300 according to a fifth exemplary variation of the above-stated exemplary embodiment of the present invention provides one second size adjustment unit 343 of a plate shape having a predetermined length in order to provide a predetermined size and one first size adjustment unit 341 that has a plurality of shape change holes 341*b* at one of lateral ends of the second size adjustment unit 343 and that can thus adjust a minute size.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

200, 300: size adjustment device
210, 230, 310, 330: size adjustment member
211, 231, 241, 311, 331, 341: first size adjustment unit
213, 233, 243, 313, 333,343: second size adjustment unit
211*a*, 231*a*, 241*a*, 311*a*, 331*a*, 341*a*: first size adjustment unit body
211*b*, 231*b*, 241*b*, 311*b*, 331*b*, 341*b*: shape change hole
214, 314: decorative member
215, 235, 315, 335: coupling member
370: connection member Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. Headwear having an opening and a size adjustment device that are formed in a head receiving portion, wherein the size adjustment device comprises:

a first size adjustment member defining a first longitudinal axis;

a second size adjustment member defining a second longitudinal axis;

wherein said first longitudinal axis of said first size adjustment member is collinear with said second longitudinal axis of said second size adjustment member;

wherein at least one of said first size adjustment member and said second size adjustment member define a first size adjustment unit that defines shape change holes, each of the shape change holes having a constant size and a constant shape, said first size adjustment unit disposed at a lower part of the opening adjusting a size by deforming the shape of said shape change holes for establishing an appropriate size for wearing comfort, a second size adjustment unit being connected to the first size adjustment unit to adjust a size to a constant gap;

wherein said size adjustment of said first size adjustment unit is less than said constant gap size adjustment of said second size adjustment unit; and wherein the first size adjustment unit has a body having a vertical longitudinal dimension and a horizontal width dimension, said body defining each of the shape change holes and, said body having vertical symmetry, each of the shape change holes having a longitudinal diameter almost corresponding to a width of the body.

2. The headwear of claim 1, wherein a gap between each of the shape change holes is smaller than a transverse diameter of each of the shape change holes.

3. The headwear of claim 1, wherein the first size adjustment unit and the second size adjustment unit are integrally formed.

4. The headwear of claim 1, wherein the first size adjustment unit and the second size adjustment unit are separately formed, and a connection member is formed between the first size adjustment unit and the second size adjustment unit.

5. The headwear of claim 4, wherein the connection member is formed with a recess that is formed in one of the first size adjustment unit and the second size adjustment unit and a protrusion that is formed in the other one of the first size adjustment unit and the second size adjustment unit, and the protrusion has a narrow neck and a wide head.

6. The headwear of claim 5, wherein there are two of each of the first size adjustment unit and the second size adjustment unit.

7. The headwear of claim 5, wherein there is single first size adjustment unit.

8. The headwear of claim 1, wherein the body of the first size adjustment unit and the body of the second size adjustment unit are made of different materials and the first size adjustment unit is made of a softer material than that of the second size adjustment unit.

9. The headwear of claim 1, wherein the second size adjustment unit has a decorative portion at one surface that is exposed.

10. The headwear of claim 1 wherein:

said first size adjustment unit is on at least one of the first size adjustment member and the second size adjustment member; and wherein each of the shape change holes has a vertical dimension that is greater than a minimum width dimension of said at least one of said first size adjustment member and said second size adjustment member which define said shape change holes.

* * * * *